United States Patent [19]

Jones

[11] Patent Number: 4,635,616

[45] Date of Patent: Jan. 13, 1987

[54] FIREPLACE

[75] Inventor: Arthur G. Jones, Johannesburg, South Africa

[73] Assignee: Jetmaster (Proprietary) Limited, South Africa

[21] Appl. No.: 807,978

[22] Filed: Dec. 12, 1985

[30] Foreign Application Priority Data

Oct. 24, 1985 [ZA] South Africa ..... 85/8165

[51] Int. Cl.[4] ..... F23L 3/00

[52] U.S. Cl. ..... 126/288; 126/285 R

[58] Field of Search ..... 126/288, 289, 286, 285 R, 126/292, 290; 98/110, 121 A

[56] References Cited

U.S. PATENT DOCUMENTS

| | | | |
|---|---|---|---|
| 1,278,987 | 9/1918 | Nordwall | 126/288 |
| 2,207,291 | 7/1940 | Hedstrom | 126/288 |
| 4,355,567 | 10/1982 | Josephson | 98/110 |

*Primary Examiner*—James C. Yeung

*Attorney, Agent, or Firm*—Steele, Gould & Fried

[57] ABSTRACT

A fireplace comprising a base adapted to support a fire grate, side walls extending from the base, a passage for the flow of combustion gases from the fire grate and a damper in the passage for controlling the flow of the combustion gases. The damper carries a shaft and is displacable about the axis of the shaft. The shaft is axially displacable to permit ready mounting of the damper in and demounting thereof from the fireplace.

6 Claims, 6 Drawing Figures

FIREPLACE

FIELD OF THE INVENTION

This invention relates to a fireplace and more particularly to a fireplace having a damper.

BACKGROUND OF THE INVENTION

A damper in a fireplace regulates the flow of hot gases up the chimney and controls the rate of combustion in the fire grate. Because they are located in the flow path of the hot gases of a fireplace, dampers present a hindrance in fireplaces with chimneys which have to be swept. In such cases the sweeping equipment has to pass the damper, which is inconvenient if not impossible.

A further disadvantage attaching to a conventional damper is that if it should malfunction, considerable difficulty may be encountered in replacing it.

It is an object of the invention to provide a fireplace in which the above disadvantages are sought to be overcome.

SUMMARY OF THE INVENTION

A fireplace according to the invention comprises a base adapted to support a fire grate, side walls extending from the base, a passage for the flow of combustion gases from the fire grate and a damper in the passage for controlling the flow of the combustion gases, the damper carrying a shaft and being displacable about the axis of the shaft, the shaft being axially displacable to permit ready mounting of the damper in and demounting thereof from the fireplace.

The shaft may be one of a pair of stub shafts provided at opposite ends of the damper. Either or both such stub shafts may be axially displacable.

The damper may extend between the side walls of the fireplace, each stub shaft projecting through a hole in its associated side wall.

The invention also concerns a damper for use in a fireplace comprising a plate carrying a shaft, the plate being adapted in an operative position thereof to pivot about the axis of the shaft, the shaft being axially displacable to permit ready mounting of the damper in and demounting thereof from the fireplace.

The shaft may be housed in a sleeve secured to the damper and may have means associated with it for locking it in an extended position and in a retracted position. Such means may comprise a bolt receivable in a threaded bore extending through the shaft in a direction normal to its axis, the sleeve having a slot therein to accommodate the bolt. The plate of the damper carries a handle by means of which it can be displaced about the axis of the shaft.

BRIEF DESCRIPTION OF THE DRAWINGS

Preferred embodiments of the invention will now be described by way of example, with reference to the accompanying drawings in which.

DESCRIPTION OF PREFERRED EMBODIMENTS

Figure 1:
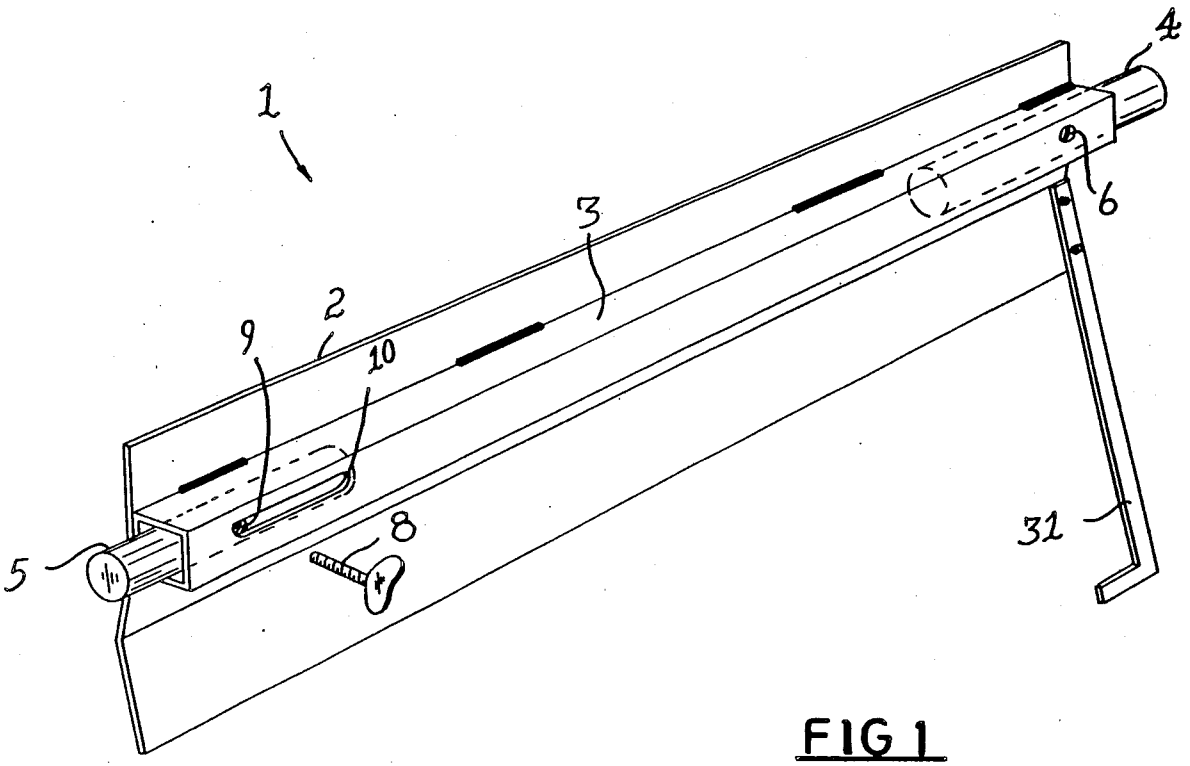
FIG. 1 is a perspective view of a damper according to the invention.

A damper 1 comprises a steel plate 2 of generally planar form but bent along its length at points **2*a* and 2*b* to increase its rigidity. The plate has a sleeve 3 of square cross-section welded to its underside and extending along its length. The sleeve 3 houses a pair of stub shafts 4, 5 at opposite ends thereof. The stub shaft 4 is welded to the sleeve 3 through an aperture 6 in the sleeve. The stud shaft 5 is axially displacable between an extended position shown in FIG. 1 and a retracted position in which it is housed within the sleeve 3. The stud shaft 5 carries a bolt 8 which is received in a threaded bore 9 extending through the shaft at right angles thereto. To accommodate the bolt 8, a slot 10 is provided in the sleeve 3. Thus, when the bolt 8 is engaged on the stub shaft 5 the latter can be displaced axially a distance equal to the length of the slot 10, with the extended and retracted positions of the stub shaft being determined by the ends of the slot 10. When the bolt 8 is tightened, it secures the shaft 5** in position.

Figure 3:
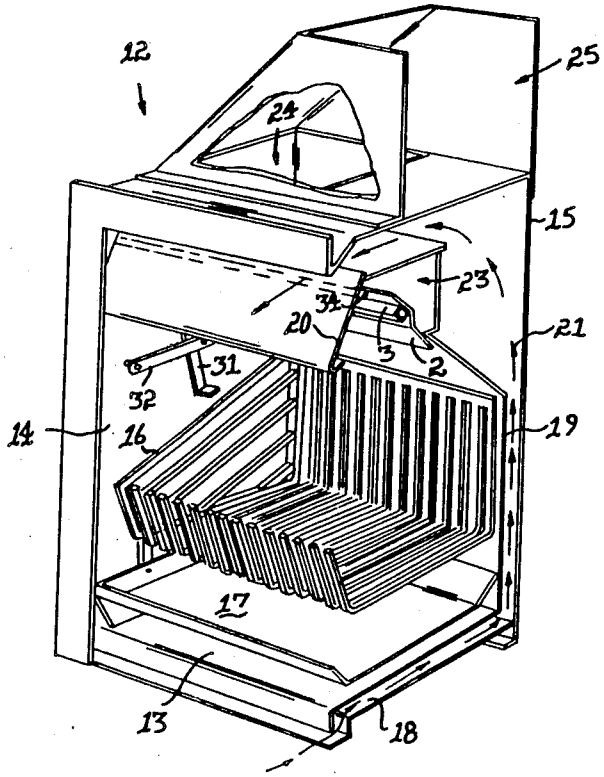
FIG. 3 is a broken, perspective view of a metal fireplace, incorporating the damper of FIGS. 1 and 2.

The damper 1 is mounted in a fireplace 12 made of sheet metal (FIG. 3). The fireplace 12 comprises a base 13, a pair of opposed side walls 14 extending from the base and a rear wall 15 joining the side walls. The base 13 supports a fire grate 16 and an ash tray 17. A passage 18 is provided under the base 13 from where a convection air current passes behind a back plate 19 and over a hood 20, into the zone in front of the fireplace. The air current is indicated by the arrows 21 in FIG. 3. The air current is isolated from the combustion gases which pass from the fire grate 16, past the damper 1, into a smoke chamber 23 behind the damper, up two passages 24 (one of which is shown in FIG. 3) into a flue 25, from where the gases pass up a chimney (not shown).

Figure 2:
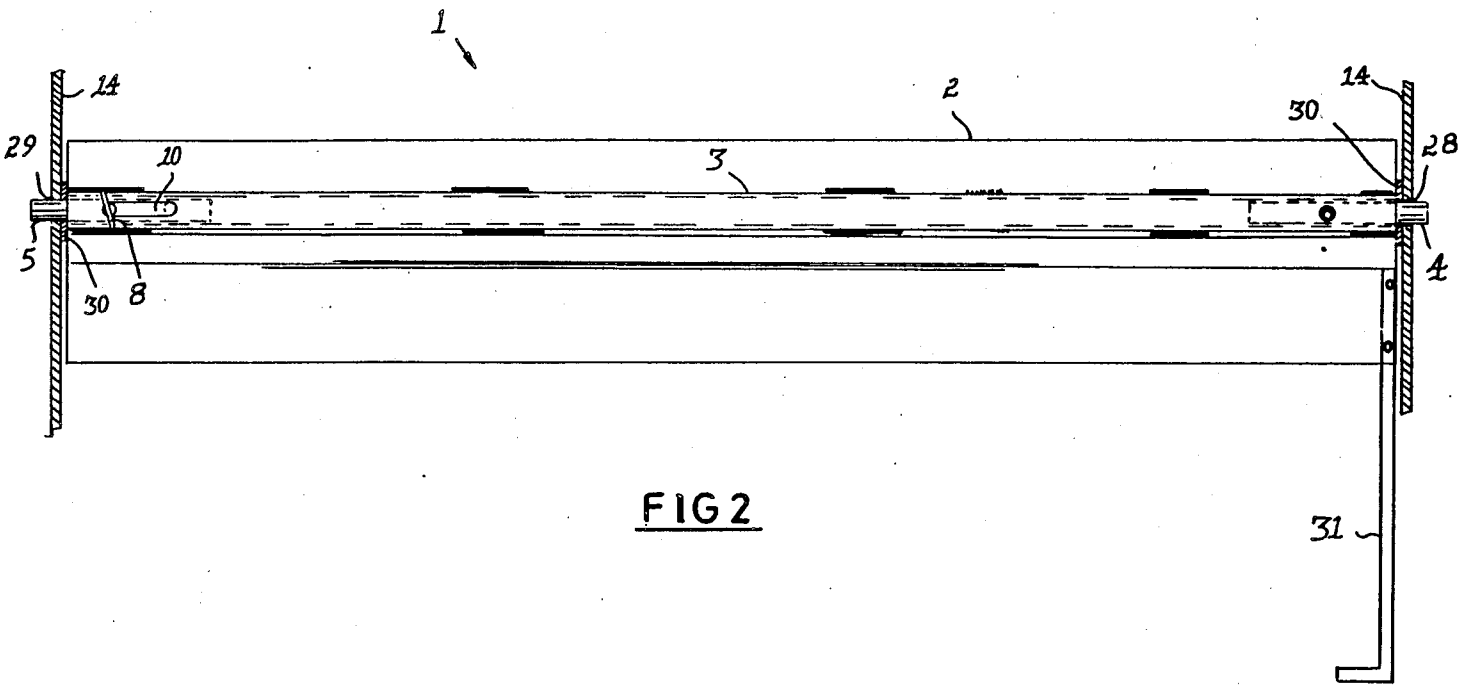
FIG. 2 is an elevation of the damper of FIG. 1 when mounted in a fireplace.

The damper 1 is mounted between the side walls 14 of the fireplace, with the stub shafts 4, 5 passing through apertures 28, 29 in the side walls (FIG. 2). In order to mount the damper, the stud shaft 5 is first retracted and the stub shaft 4 is located in the aperture 28 in its associated side wall 14. The stub shaft 5 is then extended through the aperture 29 in its associated side wall 14 and the bolt 9 is fastened to lock the stub shaft 5 in position. In order to remove the damper 1 from the fireplace, the reverse procedure is adopted. Steel washers 30 may be located on the stub shafts 4, 5 between the damper and the associated side walls 14 of the fireplace.

In an alternative arrangement, the stub shaft 4 may be also axially displacable in the manner of the stub shaft 5 to facilitate mounting and demounting of the damper.

Figure 4:
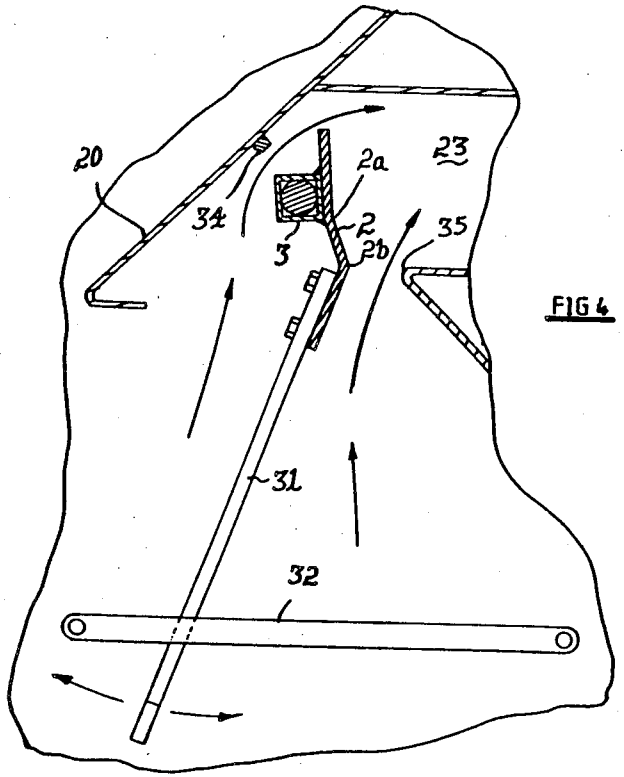

The damper 1 has a handle 31 attached thereto which is located behind a friction bar 32 provided on a side wall 14 of the fireplace 12. The friction bar serves to inhibit displacement of the handle 31 and thereby serves to keep the damper in a selected orientation. Should the friction bar fail in its purpose, the damper is so arranged that it will open under its own weight to the position shown in FIG. 4. This is a safety feature allowing flames from the fire grate to pass upwardly into the fireplace (and not to spill into the zone in front of the firegrate).

Figure 5:
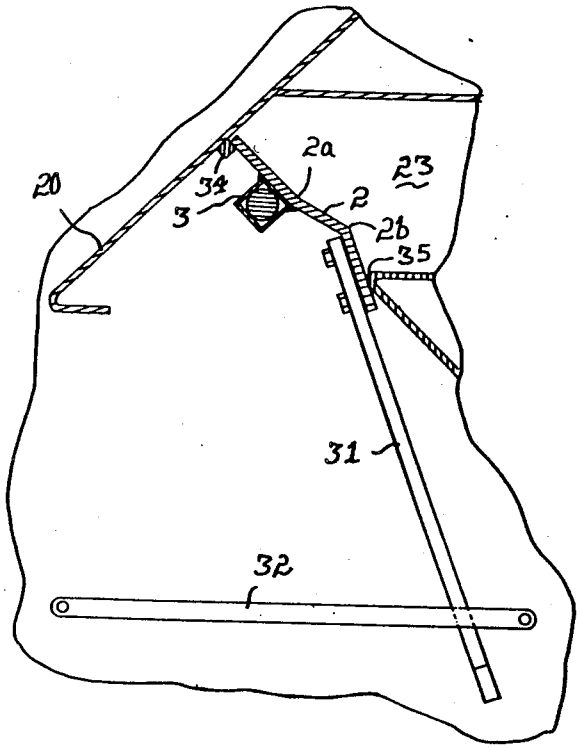
FIGS. 4 and 5 are cross-sections of part of the fireplace of FIG. 3 showing the damper in an open and closed position respectively.

The closed position of the damper is shown in FIG. 5, in which position the damper provides a good seal preventing the flow of gases to the smoke chamber 23. In its closed position, the upper longitudinal edge of the damper seats on a rib 34 provided on the underside of the hood 20 and the lower horizontal edge of the damper seats on a peak 35 formed in the back plate 19 of the fireplace.

Figure 6:
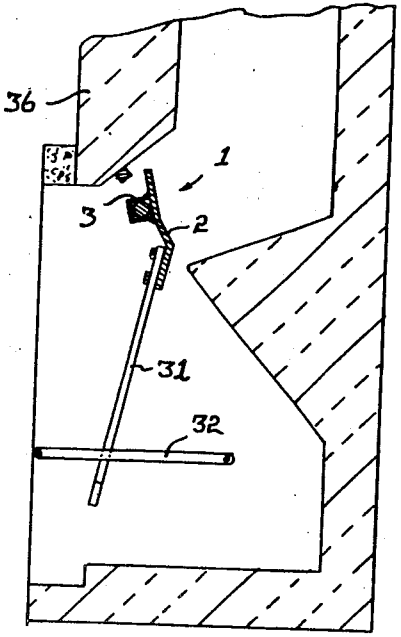
FIG. 6 shows the damper of FIGS. 1 and 2 mounted in a masonry fireplace.

In FIG. 6, the damper 1 is shown mounted in a masonry fireplace 36, where it operates in the same manner as in the fireplace described above.

Many other embodiments of the invention may be made differing in matters of detail from that described above without departing from the scope of the invention defined in the appended claims.

I claim:

1. A fireplace having a fire grate and a passage for the flow of combination gases from the fire grate comprising a base adapted to support the fire grate, side walls extending from said base, a damper in the passage for controlling the flow of combustion gases, said damper carrying a pair of stub shafts provided at opposite ends thereof and located on a common axis, said damper extending between said side walls of the fireplace with each of said stub shafts projecting through a hole in its associated side wall, said damper being displacable about said common axis of said stub shafts, said damper having a handle for causing said displacement, a friction bar associated with said handle mounted on one of said wide walls, said friction bar being adapted for frictionally inhibiting displacement of said handle, said stub shafts being housed in a sleeve secured to said sleeve having a longitudinal slot formed therein, at least one of said stub shafts being capable of axial displacement in said sleeve for readily mounted said damper in and demounting thereof from the fireplace, said one stub shaft carrying a bolt receivable in a threaded bore extending through said stub shaft in a direction normal to its axis, said bolt providing means for locking said stub shaft in an extended position and in a retracted position relative to said sleeve, said bolt passing through said longitudinal slot formed in said sleeve, said one stub shaft being displacable in said sleeve by displacement of said bolt along said slot, said slot having ends serving in cooperation with said bolt to determine the extended and retracted positions of said stub shafts, said damper being formed so that failure of said friction bar to inhibit displacement of said handle will cause said damper to open under its own weight to permit flow of combustion gases through said passage.

2. A fireplace according to claim 1 in which said sleeve is substantially square in cross-section and is welded onto said damper.

3. A fireplace according to claim 1 in which said damper comprises a plate bent along its length to increase its rigidity.

4. A damper for use in controlling flow of combustion gases along a passage in a fireplace comprising a plate having a pair of stub shafts provided at opposite ends thereof and located on a common axis, said plate being adapted to pivot in an operative position about said common axis of said stub shafts, said damper having a handle for causing displacement of said damper, said handle in an operative position thereof being associated with a friction bar mounted on the fireplace, said friction bar being adapted for frictionally inhibiting displacement of said handle, said stub shafts being housed in a sleeve secured to said damper, said sleeve having a longitudinal slot formed therein, at least one of said stub shafts being capable of axial displacement in said sleeve for readily mounting said damper in and demounting thereof from the fireplace, said one stub shaft carrying a bolt receivable in a threaded bore extending through said stub shaft in a direction normal to its axis, said bolt providing means for locking said stub shaft in an extended position and in a retracted position relative to said sleeve, said one stub shaft being displacable in said sleeve by displacement of said bolt along said slot, said slot having ends serving in cooperation with said bolt to determine the extended and retracted positions of said stub shafts, said damper being formed so that failure of said friction bar to inhibit displacement of said handle will cause said damper to open under its own weight to permit flow of combustion gases through said passage.

5. A damper according to claim 4 in which said sleeve is square in cross-section and is welded to said plate.

6. A damper according to claim 4 in which said plate is bent along its length to increase its rigidity.

* * * * *